US008593049B2

(12) United States Patent
Son et al.

(10) Patent No.: US 8,593,049 B2
(45) Date of Patent: Nov. 26, 2013

(54) FIELD ELECTRON EMITTER, FIELD ELECTRON EMISSION DEVICE INCLUDING THE SAME, AND METHOD OF MANUFACTURING THE FIELD ELECTRON EMITTER

(75) Inventors: Yoon-chul Son, Hwaseong-si (KR); Yong-chul Kim, Seoul (KR); Jeong-na Heo, Yongin-si (KR); Woo-sung Cho, Seoul (KR); Byeong-kwon Ju, Seoul (KR)

(73) Assignees: Samsung Electronics Co., Ltd. (KR); Korea University Research and Business Foundation (KR)

( * ) Notice: Subject to any disclaimer, the term of this patent is extended or adjusted under 35 U.S.C. 154(b) by 84 days.

(21) Appl. No.: 12/562,470

(22) Filed: Sep. 18, 2009

(65) Prior Publication Data

US 2010/0171407 A1 Jul. 8, 2010

(30) Foreign Application Priority Data

Jan. 8, 2009 (KR) ..... 10-2009-0001602

(51) Int. Cl.
*H01J 1/304* (2006.01)

(52) U.S. Cl.
USPC ..... 313/311; 313/495; 445/51

(58) Field of Classification Search
USPC ..... 313/311, 495; 445/51
See application file for complete search history.

(56) References Cited

U.S. PATENT DOCUMENTS

| | | | | |
|---|---|---|---|---|
| 7,187,112 | B2 | 3/2007 | Nakamoto | |
| 2004/0132072 | A1 | 7/2004 | Zheng et al. | |
| 2006/0061257 | A1* | 3/2006 | Nakamoto | 313/496 |
| 2006/0244364 | A1 | 11/2006 | Nakamoto | |
| 2010/0007266 | A1* | 1/2010 | Kim et al. | 313/496 |
| 2010/0181894 | A1* | 7/2010 | Son et al. | 313/310 |

FOREIGN PATENT DOCUMENTS

| | | | |
|---|---|---|---|
| JP | 2004082663 | A | 3/2004 |
| KR | 1020050111139 | A | 11/2005 |
| KR | 1020060021257 | A | 3/2006 |
| KR | 1020060046974 | A | 5/2006 |
| KR | 1020060079898 | A | 7/2006 |
| KR | 1020060081494 | A | 7/2006 |
| KR | 1020060086699 | A | 8/2006 |
| KR | 1020070001769 | A | 1/2007 |
| KR | 1020070017747 | A | 2/2007 |
| KR | 100743018 | B1 | 7/2007 |
| KR | 100748228 | B1 | 8/2007 |
| KR | 1020060019369 | * | 8/2007 |
| KR | 1020080006814 | A | 1/2008 |
| KR | 10-2008-0084461 | * | 9/2008 |

OTHER PUBLICATIONS

Non-Final Office Action dated Oct. 12, 2011 from U.S. Appl. No. 12/562,789.

(Continued)

*Primary Examiner* — Karabi Guharay
(74) *Attorney, Agent, or Firm* — Cantor Colburn LLP

(57) ABSTRACT

A field electron emitter including a metal electrode; and a plurality of carbon nanotubes, wherein a portion of the plurality of carbon nanotubes protrude from a surface of the metal electrode and a portion of the plurality of carbon nanotubes are in the metal electrode. Also disclosed is a field electron emission device including the field electron emitter and a method of manufacturing the field electron emitter.

23 Claims, 4 Drawing Sheets

(56) References Cited

OTHER PUBLICATIONS

Li et al., DNA-Directed Self-Assembling of Carbon Nanotubes, J. AM. CHEM. SOC. 2005, 127, 14-15.

Baker et al., Covalently Bonded Adducts of Deoxyribonucleic Acid (DNA) Oligonucleotides with Single-Wall Carbon Nanotubes: Synthesis and Hybridization, NANO Letters (2002), vol. 2, No. 12, pp. 1413-1417.

* cited by examiner

FIELD ELECTRON EMITTER, FIELD ELECTRON EMISSION DEVICE INCLUDING THE SAME, AND METHOD OF MANUFACTURING THE FIELD ELECTRON EMITTER

CROSS-REFERENCE TO RELATED APPLICATION

This application claims priority to Korean Patent Application No. 10-2009-0001602, filed on Jan. 8, 2009, and all the benefits accruing therefrom under 35 U.S.C. §119, the content of which in its entirety is herein incorporated by reference.

The patent or application file contains at least one drawing executed in color. Copies of this patent or patent application publication with color drawings will be provided by the Office upon request and payment of the necessary fee.

This application is pursuant to a joint research agreement between Samsung Electronics, Co. Ltd., and Korea University Research and Business Foundation.

BACKGROUND

1. Field

One or more embodiments relate to a field electron emitter, a field electron emission device including the same, and a method of manufacturing the field electron emitter.

2. Description of the Related Art

Field electron emitters use carbon nanotubes as a field emission tip. Field electron emitters are manufactured by depositing carbon nanotubes on an anode. Alternatively, field electron emitters can also be manufactured by printing a carbon nanotube paste including carbon nanotubes, a binder and a filler on a substrate.

When carbon nanotubes are deposited using a vapor deposition method, the manufacturing process is complicated and may employ expensive equipment. Thus, carbon nanotube pastes are more often used.

However, even when field electron emitters are manufactured using a carbon nanotube paste, a printing process, a high-temperature sintering process and an activation process are employed. Accordingly, there remains a need in the art for an improved field electron emitter and an improved method of manufacturing the field electron emitter.

SUMMARY

One or more embodiments include a field electron emitter having a new structure.

One or more embodiments include a field electron emission device including a field electron emitter.

One or more embodiments include a method of manufacturing the field electron emitter.

Additional aspects, features and advantages will be set forth in the description which follows.

According to one or more embodiments, disclosed is a field electron emitter including: a metal electrode; and a plurality of carbon nanotubes, wherein a portion of the plurality of carbon nanotubes protrude from a surface of the metal electrode and a portion of the plurality of carbon nanotubes are in the metal electrode.

According to one or more embodiments, disclosed is a field electron emission device including a field electron emitter, the field electron emitter including: a metal electrode; and a plurality of carbon nanotubes, wherein at least a portion of the plurality of carbon nanotubes protrude from a surface of the metal electrode and a portion of the plurality of carbon nanotubes are in the metal electrode.

According to one or more embodiments, also disclosed is a method of manufacturing a field electron emitter. The method includes: immersing a substrate in a plating solution; forming a plating layer on at least a portion of the immersed substrate; and removing at least a portion of a nucleic acid exposed on a surface of the plating layer, wherein the plating solution includes a plurality of carbon nanotubes, the nucleic acid, and a plurality of metal ions.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
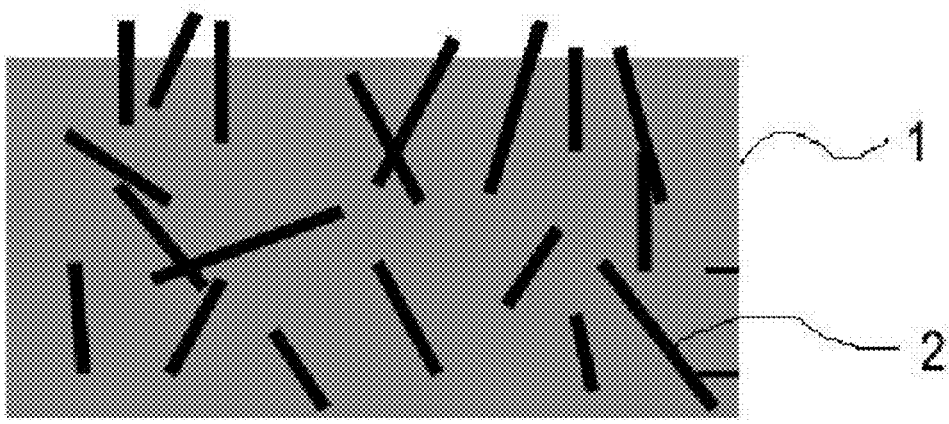
FIG. 1 is a schematic diagram of an exemplary embodiment of a field electron emitter.

Reference will now be made in further detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects, features and advantages of the present description.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, a field electron emitter according to an embodiment, a field electron emission device including the same and a method of manufacturing the field electron emitter will be described in further detail.

A field electron emitter according to an embodiment comprises: a metal electrode 1 and a plurality of carbon nanotubes 2, wherein a portion of the plurality of carbon nanotubes protrude from a surface of the metal electrode and a portion of the plurality of carbon nanotubes are in the metal electrode. Thus the carbon nanotubes may be fully or partially contained in the metal electrode. Thus in one embodiment, a portion (e.g., a majority) of the carbon nanotubes are entirely contained within the metal electrode and another portion (e.g. a minority) of the carbon nanotubes are partially within the metal electrode and partially exposed on the surface of the metal electrode.

In an embodiment, the metal electrode and the plurality of carbon nanotubes form a single unitary body. In another embodiment, the metal electrode and the plurality of carbon nanotubes form a single unitary indivisible body. Because the metal electrode and the plurality of carbon nanotubes are, in an embodiment, a single unitary indivisible body, the metal electrode and an electron emission tip may also have a single unitary indivisible body structure. While not wanting to be bound by theory, it is believed that reliability of the field electron emitter is improved because the metal electrode and an electron emission tip have a single unitary body structure, and is further improved wherein the metal electrode and an electron emission tip have a single unitary indivisible body structure. In addition, because the metal electrode is directly electrically connected to the electron emission tip without use of other additives, an interfacial resistance between the metal electrode and the electron emission tip is reduced. It is also believed that an electron emission efficiency of the field electron emitter is improved because the interfacial resistance between the metal electrode and the electron emission tip is reduced. FIG. 1 is a schematic diagram of an exemplary embodiment of a field electron emitter.

According to an embodiment, the field electron emitter may further comprise a nucleic acid in the metal electrode. That is, at least a portion of the plurality of carbon nanotubes present in the metal electrode may be contacted (e.g., coated) with a nucleic acid over a portion of or an entirety of each of the carbon nanotubes. In another embodiment, an entirety of the plurality of carbon nanotubes present in the metal electrode may contact the nucleic acid. In an embodiment, the nucleic acid may not be substantially present on the portions of the carbon nanotubes protruding from the surface of the metal electrode. The electron emission performance of the field electron emitter may not be substantially affected by the presence of the nucleic acid on the portions of the carbon nanotubes protruding from the surface of the metal electrode.

According to an embodiment, the metal layer of the field electron emitter may be a plating layer formed by plating. The plating layer may be formed using any plating method known in the art. For example, the plating layer may be formed by electroplating or electroless plating. The plating layer may have a dense structure, thus pores may not be formed therein, and the metal electrode and the carbon nanotubes may form a single unitary body. Further, since the field electron emitter is formed by plating with a plating solution, which includes metal ions and carbon nanotubes, the manufacturing process may be facilitated and the manufacturing costs are low.

According to an embodiment, the metal electrode may comprise at least one metal selected from the group consisting of Sc, Ti, V, Cr, Mn, Fe, Co, Ni, Cu, Zn, Pd, Ag, Au, Hg, Pt, Ta, Mo, Zr, Ta, Mg, Sn, Ge, Y, Nb, Tc, Ru, Rh, Lu, Hf, W, Re, Os, Ir, Lr, Rf, Db, Sg, Bh, Hs, Mt, Ds, Rg and Uub, but is not limited thereto. For example, the metal electrode may include any metal that can be used to form a metal electrode in the art and may exist in an ionic state in a solution.

According to an embodiment, the metal electrode may further comprise at least one element selected from the group consisting of P, B, N, C, O and H. These elements may act as a reductant, which reduce a portion of or an entirety of the plurality of metal ions when the plating layer is formed by electroless plating. In an embodiment, any other element, which is contained in a compound used as the reductant of the metal ions, may be used without limitation. During reduction of the metal ions, the reductant may be included in the plating layer together with the reduced metal.

According to an embodiment, the nucleic acid may comprise at least one nucleic acid selected from the group consisting of DNA, complementary DNA ("cDNA"), chloroplast DNA ("cpDNA"), multicopy single-stranded DNA ("msDNA"), mitochondrial DNA ("mtDNA"), RNA, messenger RNA ("mRNA"), transfer RNA ("tRNA"), glycerol nucleic acid ("GNA"), locked nucleic acid ("LNA"), peptide nucleic acid ("PNA") and threose nucleic acid ("TNA"), but is not limited thereto. The nucleic acid may be any nucleic acid that is known in the art.

According to an embodiment, the nucleic acid may comprise at least one nitrogen-containing heterocyclic base selected from the group consisting of adenine ("A"), guanine ("G"), thymine ("T"), cytosine ("C") and uracil ("U"). In addition, the nucleic acid may further include, in addition to the heterocyclic base, a pentose sugar and/or a phosphate group.

According to an embodiment, the plurality of carbon nanotubes may comprise at least one carbon nanotube selected from the group consisting of single-walled carbon nanotubes, double-walled carbon nanotubes, multi-walled carbon nanotubes, metallic carbon nanotubes and semiconducting carbon nanotubes, but are not limited thereto. For example, the carbon nanotube may be any carbon nanotube known in the art.

According to an embodiment, the amount of the carbon nanotubes may be about 0.1 weight percent ("wt %") to about 80 wt %, specifically about 1 wt % to about 60 wt %, more specifically about 5 wt % to about 40 wt %, based on the total weight of a field electron emitter.

Figure 2:
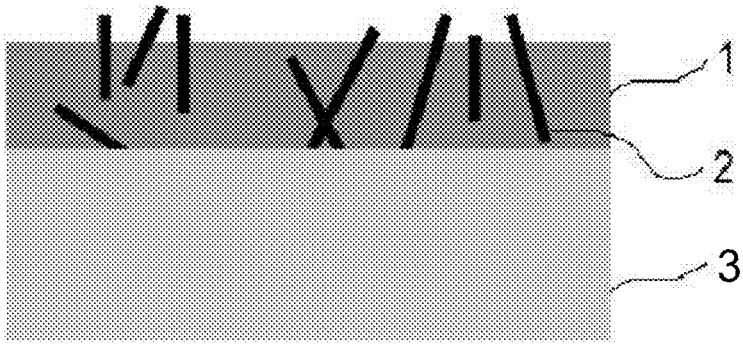
FIG. 2 is a schematic diagram of another exemplary embodiment of a field electron emitter.

According to an embodiment, the metal electrode may further comprise a lower electrode disposed (e.g., formed) on a bottom surface of the metal electrode. The lower electrode may comprise a metal that is the same as or different from a metal used to form the metal electrode (that is, an upper electrode). The lower electrode may be disposed (e.g., formed) using any method known in the art. For example, the lower electrode may be formed by deposition. The metal, which is used to form the lower electrode, may be any metal used in the art. The lower electrode may comprise a pure metal, thus the lower electrode may comprise a metal, which does not include carbon nanotubes. The lower electrode may be a cathode of a field electron emission device. FIG. 2 is a schematic diagram of another exemplary embodiment of a field electron emitter, wherein the field electron emitter further includes the lower electrode 3.

Figure 3:
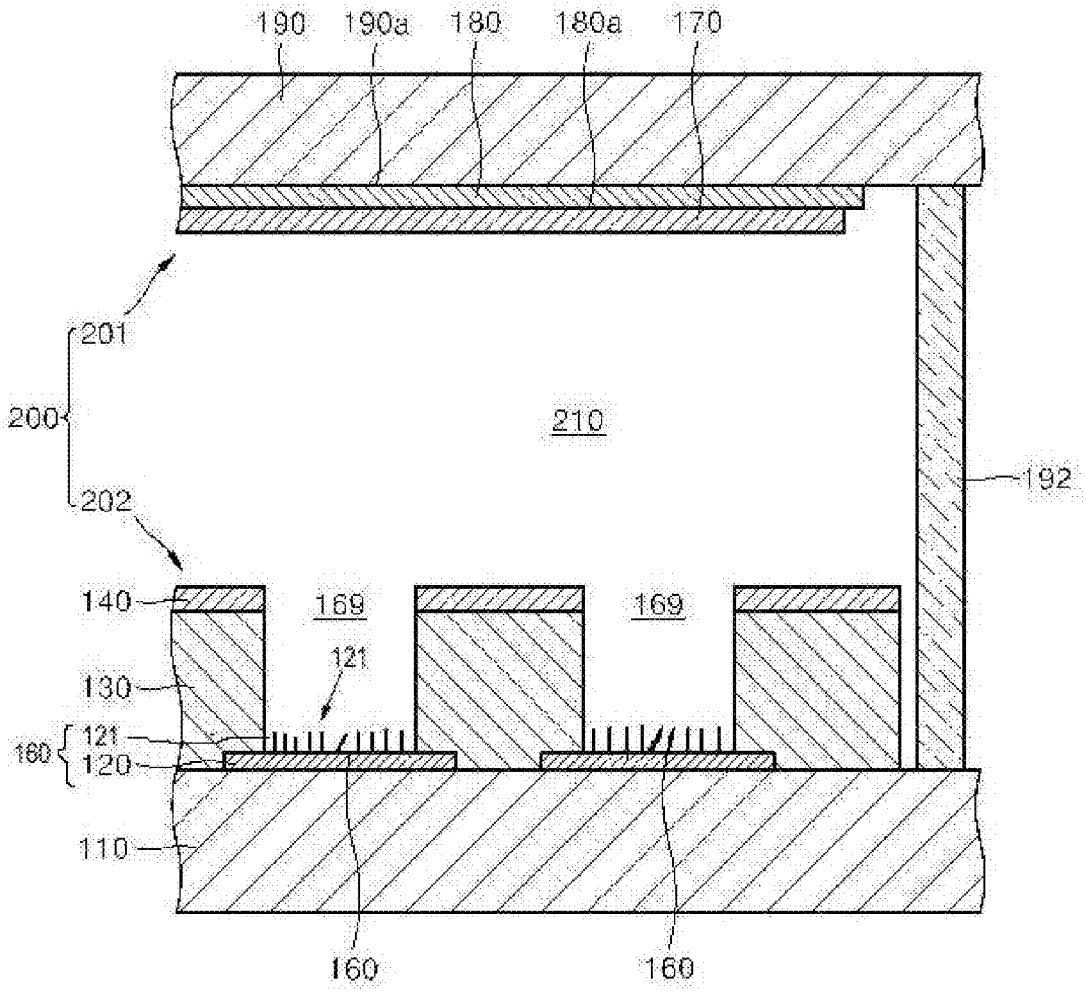
FIG. 3 is a schematic sectional diagram illustrating an exemplary embodiment of a field electron emission device.

A field electron emission device according to an embodiment includes the field electron emitter. FIG. 3 is a schematic sectional diagram illustrating an exemplary embodiment of a field electron emission device 200. The field electron emission device 200 illustrated in FIG. 3 has a tripod structure. Referring to FIG. 3, the field electron emission device 200 includes a top panel 201 and a bottom panel 202. The top panel includes a top substrate 190, an anode 180 disposed on a lower surface 190*a* of the top substrate 190, and a fluorescent layer 170 disposed on a lower surface 180*a* of the anode 180. The fluorescent layer 170 includes a phosphor.

The bottom panel 202 includes a bottom substrate 110, which is disposed in such a way that the bottom substrate 110 faces and is parallel to the top substrate 190, and the bottom substrate 110 and the top substrate 190 are spaced apart from each other by a selected distance, thereby defining an inner space 210. The bottom panel 202 further includes a cathode 120 disposed in a stripe pattern on the bottom substrate 110, a gate electrode 140 disposed in a stripe pattern crossing the stripe pattern of the cathode 120, an insulating layer 130 disposed between the gate electrode 140 and the cathode 120, a field electron emitter hole 169, which is defined by portions of the insulating layer 130 and the gate electrode 140, and carbon nanotubes 121, which are disposed substantially or completely inside the field electron emitter hole 169 and form a single unitary body with the cathode 120. Together, the cathode 120 and the carbon nanotubes 121 constitute a field electron emitter 160. In this regard, the structure of the field electron emitter 160 has been further described above.

The cathode 120 (constituting a metal electrode) of the field electron emitter 160 may comprise at least one metal selected from the group consisting of Sc, Ti, V, Cr, Mn, Fe, Co, Ni, Cu, Zn, Pd, Ag, Au, Hg, Pt, Ta, Mo, Zr, Ta, Mg, Sn, Ge, Y, Nb, Tc, Ru, Rh, Lu, Hf, W, Re, Os, Ir, Lr, Rf, Db, Sg, Bh, Hs, Mt, Ds, Rg and Uub. In an embodiment, the metal, which is used to form the cathode 120, is not limited to these materials. For example, the metal, which is used to form the cathode 120, may be any metal used to form a metal electrode in the art and may exist in an ionic state in a solution.

Although not illustrated in FIG. 3, the field electron emitter 160 may further comprise a lower electrode disposed on a lower surface of the cathode 120. The lower electrode may comprise a metal, which is the same as or different from the metal used to form the cathode 120. The lower electrode may be disposed (e.g., formed) using any method known in the art. For example, the lower electrode may be disposed (e.g., formed) by deposition. The metal, which is used to form the lower electrode, may comprise any metal used in the art. In addition, the lower electrode may also be a transparent electrode comprising, for example, indium tin oxide ("ITO"), aluminum doped zinc oxide, zinc doped indium oxide gallium indium oxide, or the like or a combination comprising at least one of the foregoing.

The top panel 201 and the bottom panel 202 are supported by a vacuum, thus inner space 210 may have a pressure lower than the atmospheric pressure. In addition, a spacer 192 is disposed between the top panel 201 and the bottom panel 202. The spacer 192 supports the pressure generated by the vacuum between the top panel 201 and the bottom panel 202, and maintains the emission space, inner space 210.

The anode 180 applies a high voltage for accelerating electrons emitted from the field electron emitter 160 so that electrons collide with the fluorescent layer 170 at high speed. The phosphor of the fluorescent layer 170 is excited by the electrons and thus, when the energy level of the excited phosphor is changed from a higher energy level to a lower energy level, visible light and the like are emitted.

The gate electrode 140 allows electrons to be emitted from the field electron emitter 160, and the insulating layer 130 defines the field electron emitter hole 169 and insulates the field electron emitter 160 from the gate electrode 140.

The field electron emission device 200 may have a tripod structure, as illustrated in FIG. 3. In another embodiment, the field electron emission device may have other structures, such as a diode structure. In addition, for a field electron emission device in which a gate electrode is disposed under a cathode, a grid or mesh for protecting the gate electrode and/or cathode from an arc, which may occur due to a discharge phenomenon, and for stably collecting electrons emitted from a field electron emitter, may be further included.

Field electron emission devices according to various embodiments may be applied to other display devices, backlight units or X-ray sources for pharmaceutical imaging. A field electron emission device according to an embodiment may be used in various applications using field electron emission, including a surface light source of a field emission display ("FED"), a liquid crystal display ("LCD") backlight unit and an X-ray source for pharmaceutical imaging.

Figure 4:
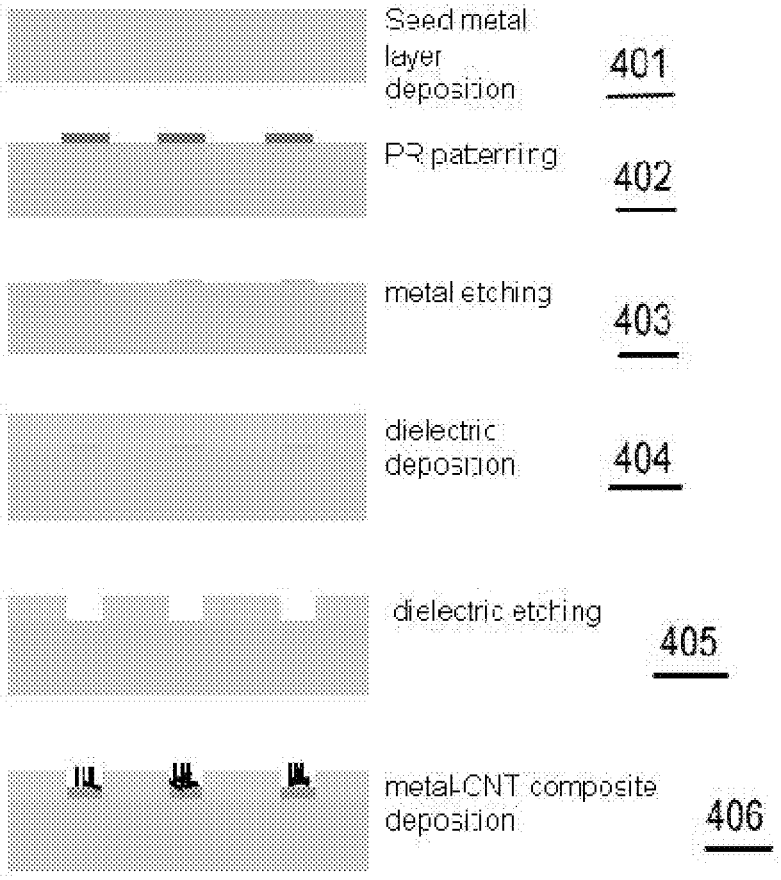
FIG. 4 is a diagram of an exemplary embodiment of a method of manufacturing a field electron emission device.

FIG. 4 is a diagram of an exemplary embodiment of a method of manufacturing a field electron emission device. In a first process 401, a seed metal is disposed (e.g. deposited) on a substrate to form a seed metal layer. The seed metal may be Mo, Cr, or the like or a combination comprising at least one of the foregoing. Then, a photomask, a photoresist, and a patterning technique known in the art are used to form a selected seed metal pattern in a second process 402 and a third process 403. Then, in a fourth process 404, an insulating material is disposed (e.g. deposited) on the seed metal pattern disposed on the substrate, and exposed to light to remove a portion of the insulating material disposed on the seed metal pattern in a fifth process 405. Then, a plating layer, comprising a metal electrode, which with a plurality of carbon nanotubes forms a single unitary body, is disposed (e.g., formed) on the seed metal pattern in a sixth process 406. Portions of some of the plurality of carbon nanotubes protruding from a surface of the metal electrode are used as a field electron emission tip. When the portions of the plurality of carbon nanotubes protruding from a surface of the metal electrode are small, an etching process may be selectively performed to expose additional portions of the plurality of carbon nanotubes. Then, subsequent processes may be performed using techniques known in the art in order to manufacture a field electron emission device.

Figure 5:
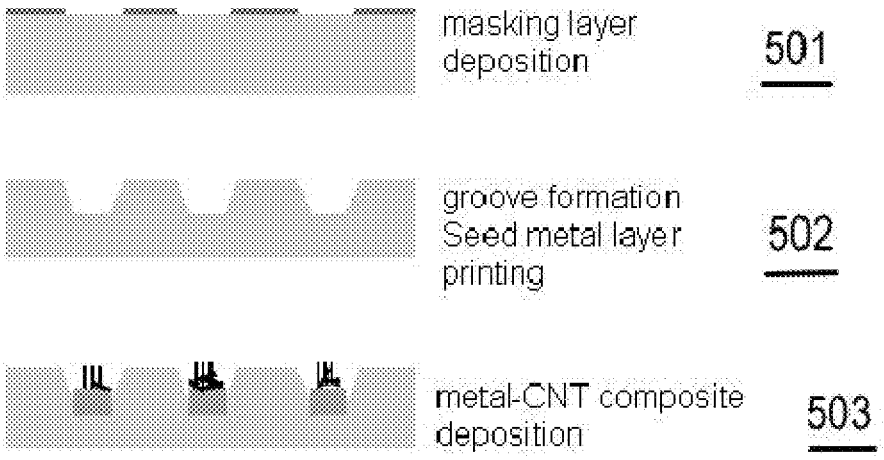
FIG. 5 is a diagram of an exemplary embodiment of a method of manufacturing a field electron emission device.

FIG. 5 is a diagram of an exemplary embodiment of another method of manufacturing a field electron emission device. The method according to the present embodiment is simpler than the method according to the previous embodiment. First, in a seventh process 501, a mask layer is disposed (e.g. formed) on an insulating substrate and then selectively etched to form a groove having a selected pattern. In an eighth process 502, a seed metal layer is disposed (e.g. formed) in the groove. Then, a plating layer, comprising a metal electrode, which with a plurality of carbon nanotubes forms a single unitary body, is disposed (e.g. formed) on the seed metal pattern in a ninth process 503. Portions of some of the plurality of carbon nanotubes protruding from a surface of the metal electrode are used as a field electron emission tip. When the portions of the plurality of carbon nanotubes protruding from a surface of the metal electrode are small, an etching process may be selectively performed to expose additional portions of the plurality of the carbon nanotube. Then, subsequent processes may be performed using techniques known in the art in order to manufacture a field electron emission device.

A method of manufacturing a field electron emitter according to an embodiment comprises immersing a substrate in a plating solution; forming a plating layer on at least a portion of the immersed substrate; and removing at least a portion of a nucleic acid exposed on a surface of the plating layer, wherein the plating solution comprises a plurality of carbon nanotubes, the nucleic acid and a plurality of metal ions.

In an embodiment, a plating solution including a plurality of carbon nanotubes, a nucleic acid and a plurality of metal ions is prepared, and then at least a portion of a substrate is immersed in the plating solution to plate the entire substrate or a portion of the substrate, thereby forming a plating layer. In an embodiment, an entirety of a substrate is immersed in the plating solution to plate substantially an entirety of the substrate. The plating solution may further include an additive, such as an electrolyte for improving conductivity, or a chelating agent, which facilitates precipitation of the metal ions. Examples of the chelating agent include a citrate salt, a tartrate salt, and a sulfamic acid. The pH of the plating solution may also be selected. The metal ions may form a complex with the nucleic acid, which contacts (e.g., is coated on) the plurality of carbon nanotubes. For example, a carbon nanotube/nucleic acid/metal ion complex may be formed. A plurality of metal ions may exist on a surface of the carbon nanotube/nucleic acid/metal ion complex. In the plating solution, a plurality of metal ions and the carbon nanotube/nucleic acid/metal ion complex may concurrently exist. In a nucleic acid, a heterocyclic base may be coordinated with and thus linked to an ion of a metal such as Ag, Hg or Pt, and a phosphate group may be coordinated with and thus linked to an ion of an alkali metal such as Li, Na or K. A transition metal ion has a d orbital, which is not fully filled with electrons and thus may form multiple bonds. For example, the transition metal ion may directly bind to the base of a nucleic acid and may indirectly bind to the phosphate group. Due to the carbon nanotube/nucleic acid/metal ion complex, the carbon nanotubes are maintained in an electrically cationic state. The carbon nanotube/nucleic acid/metal ion complex may vary according to the type of nucleic acid used and the type of metal ions used. To form the plating layer, a conducting film comprising, for example, a metal or a metal oxide may be disposed (e.g., formed) on the entire substrate or a portion of a substrate in advance. The plating layer may include the plurality of carbon nanotubes and the nucleic acid, wherein portions of some of the carbon nanotubes protrude from a surface of the plating layer. Then, the nucleic acid exposed on the surface of the plating layer may be selectively removed, thereby forming a field electron emitter in which a metal electrode and an electron emission tip are a single unitary body.

According to an embodiment, the plating layer may be formed by electroplating or electroless plating. In this regard, electroplating is relatively inexpensive.

The electroplating may be performed by loading a plating solution into an electrolytic cell, immersing a cathode and an anode in the plating solution and then, supplying a current thereto. An anode used to perform the electroplating may comprise any conducting metal used in the art. For example, the anode may comprise a metal such as copper, nickel, chromium, zinc, cadmium, tin, gold, silver, rhodium or platinum, or the like or a combination comprising at least one of the foregoing. The metal used to form an anode may be the same as a metal used to form a plating layer. During plating, when a plating layer begins to be formed at the cathode, metal ions corresponding to the precipitated metal in the plating solution are reduced. Thus, to compensate for the decrease in the concentration of the metal ions, metal ions are formed by oxidation at the anode, and thus are supplied to the plating solution. The cathode may comprise a metal, which is the same as or different from the metal that forms the plating layer. Alternatively, the cathode may also be the bottom substrate 110 on which the cathode 120 is disposed (e.g., formed), as illustrated in FIG. 3. For example, the cathode may be a glass substrate on which a conducting material is disposed. The conducting material may be molybdenum, chromium, copper, nickel, indium tin oxide ("ITO"), or the like or a combination comprising at least one of the foregoing.

Conditions for the electroplating are not particularly limited and can be readily determined by one of ordinary skill in the art without undue experimentation. For example, the current density may be about 0.01 milliamperes per square decimeter ("$mA/dm^2$") to about 1000 amperes per square decimeter ("$A/dm^2$"), specifically about 0.1 $mA/dm^2$ to about 100 $A/dm^2$, more specifically about 1 $mA/dm^2$ to about 10 $A/dm^2$, the plating time may be about 0.01 second to about 1000 hours, specifically about 0.1 second to about 100 hours, more specifically about 1 second to about 10 hours, and the applied voltage may be about 0.01 millivolts ("mV") to about 10000 volts ("V"), specifically about 0.1 mV to about 1000 V, more specifically about 1 mV to about 100 V.

The electroplating may further optionally include, before a main plating process, a pre-plating process such as strike plating to reduce unevenness and to improve uniformity of the surface of the plating layer. In this regard, any pre-plating process commonly used in electroplating may be used. In addition, the plating solution may include at least two different types of metal ions. Metal and/or alloy plating layers having various compositions may be obtained by selecting metal ions having various standard reduction potentials as is known in the art.

The composition of the plating solution used in the electroless plating may be the same as that of a plating solution known in the electroplating art, except that the plating solution used in the electroless plating includes a reductant. In this regard, in electroless plating, a plating layer is formed using a reductant instead of electricity. The reductant may be any reductant that is known in the art and which is used in electroless plating. For example, the reductant may include at least one compound selected from the group consisting of hypophosphite, borohydride, amine borane, hydrazine, formaldehyde, dimethylborane, dimethylamine borane ("DMAB"), cobalt borane, 2-oxazolidinone and the like.

In an embodiment, a portion of or the entirety of each of the plurality of carbon nanotubes in the plating solution may be contacted (e.g., coated) with the nucleic acid. In another embodiment, only some (e.g., a majority) of the carbon nanotubes contained in the plating solution may be contacted (e.g., coated) with the nucleic acid over a portion of or the entirety of each of the contacted (e.g., coated) nanotubes. Due to the coating, it is believed that all or a portion (e.g., a majority) of the carbon nanotubes are individually dispersed in the plating solution. Thus, the plating solution may not further include a surfactant to disperse the carbon nanotubes. Addition of the surfactant may lead to a decrease in plating efficiency and plating speed.

According to an embodiment, the plurality of metal ions may include an ion of at least one metal selected from the group consisting of a Group I to XVI element, as indicated in the Periodic Table of the Elements. For example, the plurality of metal ions may include an ion of at least one metal selected from the group consisting of: at least one alkali metal selected from the group consisting of Li, Na, K, Rb and Cs; at least one rare earth metal selected from the group consisting of Be, Mg, Ca, Sr and Ba; at least one transition metal selected from the group consisting of Co, Cr, Fe, Ni, Mn, Cu, Hg, Pt, Ag, Cd, Zn, Sc, Ti, V, Y, Zr, Nb, Mo, Tc, Ru, Rh, Pd, Lu, Hf, Ta, W, Re, Os, Ir, Au, Lr, Rf, Db, Sg, Bh, Hs, Mt, Ds, Rg and Uub; and at least one metal selected from the group consisting of Sn and Ge. For example, the plurality of metal ions may include an ion of at least one metal selected from the group consisting of Sc, Ti, V, Cr, Mn, Fe, Co, Ni, Cu, Zn, Pd, Ag, Au, Hg, Pt, Ta, Mo, Zr, Ta, Mg, Sn, Ge, Y, Nb, Tc, Ru, Rh, Lu, Hf, W, Re, Os, Ir, Lr, Rf, Db, Sg, Bh, Hs, Mt, Ds, Rg and Uub. An oxidation number of the plurality of metal ions is not particularly limited. For example, the oxidation number of the metal ions may be about +1 to about +3, specifically about +2.

According to an embodiment, the nucleic acid may include at least one nucleic acid selected from the group consisting of DNA, complementary DNA ("cDNA"), chloroplast DNA ("cpDNA"), multicopy single-stranded DNA ("msDNA"), mitochondrial DNA ("mtDNA"), RNA, messenger RNA ("mRNA"), transfer RNA ("tRNA"), glycerol nucleic acid ("GNA"), locked nucleic acid ("LNA"), peptide nucleic acid ("PNA") and threose nucleic acid ("TNA"), but is not limited thereto. The nucleic acid may be any nucleic acid known in the art.

According to an embodiment, the nucleic acid may also include at least one nitrogen-containing heterocyclic base selected from the group consisting of adenine ("A"), guanine ("G"), thymine ("T"), cytosine ("C") and uracil ("U"). In addition, the nucleic acid may further include, in addition to the heterocyclic base, a pentose sugar and/or a phosphate group.

In a method of manufacturing a field electron emitter according to another embodiment, the nucleic acid may include at least one nucleic acid selected from the group consisting of DNA, cDNA, cpDNA, msDNA, mtDNA, RNA, mRNA, tRNA, GNA, LNA, PNA and TNA, and is not limited thereto. The nucleic acid may be any nucleic acid known in the art.

According to an embodiment, the nucleic acid exposed on the surface of the plating layer may be removed using at least one method selected from the group consisting of sintering, etching, chemical reacting, detaching and the like. The process of removing the nucleic acid may correspond to an activation process of a field electron emission device.

According to an embodiment, the amount of carbon nanotubes contained in the plating solution may be about 0.1 volume percent ("vol %") to about 60 vol %, specifically about 1 vol % to about 40 vol %, more specifically about 5 vol % to about 20 vol %, based on the total volume of the plating solution.

According to an embodiment, the amount of the carbon nanotubes contained in the plating solution may be about 0.1 vol % to about 50 vol %, specifically about 1 vol % to about 40 vol %, more specifically about 5 vol % to about 20 vol %, based on the total volume of the plating solution.

The embodiments will be described in further detail with reference to the following examples. The following examples are for illustrative purposes only and are not intended to limit the scope of the embodiments.

Preparation of Field Electron Emitter

Example 1

Electroplating

A 40 milligram ("mg") sample of single-walled carbon nanotubes (Hipco, purity 95 percent ("%") and 40 mg of tRNA (Transfer RNA transferred from baker's yeast (*S. cerevisiae*), Sigma Aldrich, CAS Number 9014-25-9) were added to 100 milliliters ("ml") of deionized water to prepare a mixed solution. The mixed solution was mixed with 300 ml of a Ni electroplating solution ($NiSO_4.6H_2O$ 300 grams per liter ("g/L"), $NiCl_2.6H_2O$ 45 g/L, and $H_3BO_3$ 40 g/L) to prepare a plating solution. The plating solution was loaded into an electrolytic cell and then, a substrate (cathode) and an anode were immersed therein. Then, 20 mA/dm$^2$ of a current was supplied thereto for two minutes to form a plating layer having a thickness of 1 micrometer ("μm") on the substrate, thereby manufacturing a field electron emitter. The substrate was a stainless steel substrate and the anode was a nickel bar.

Example 2

Electroless Plating

A 40 mg sample of single-walled carbon nanotubes (Hipco, purity 95%) and 40 mg of tRNA (Transfer RNA transferred from baker's yeast (*S. cerevisiae*), Sigma Aldrich, CAS Number 9014-25-9) were added to 100 ml of deionized water to prepare a mixed solution. The mixed solution was mixed with 300 ml of a Ni electroless plating solution ($NaH_2PO_2.H_2O$ 10.5 g/L, $NiCl_2.6H_2O$ 28.5 g/L, $NaC_6H_5O_7.2H_2O$ 43.5 g/L, and $NH_4Cl$ 25 g/L) to prepare a plating solution. The plating solution was loaded into an electrolytic cell and then a copper substrate was immersed therein and electroless plating was performed thereon at a temperature of 85° C. for five minutes to form a plating layer having a thickness of 0.5 μm, thereby manufacturing a field electron emitter. In this experiment, the copper substrate was immersed in a Pd solution ($PdCl_2$ 0.25 g/L, HCl 2.5 ml/L) for one minute before being immersed in the Ni electroless plating solution to activate a surface of the copper substrate.

Evaluation Example 1

Experiment with Scanning Electron Microscope

Figure 6:
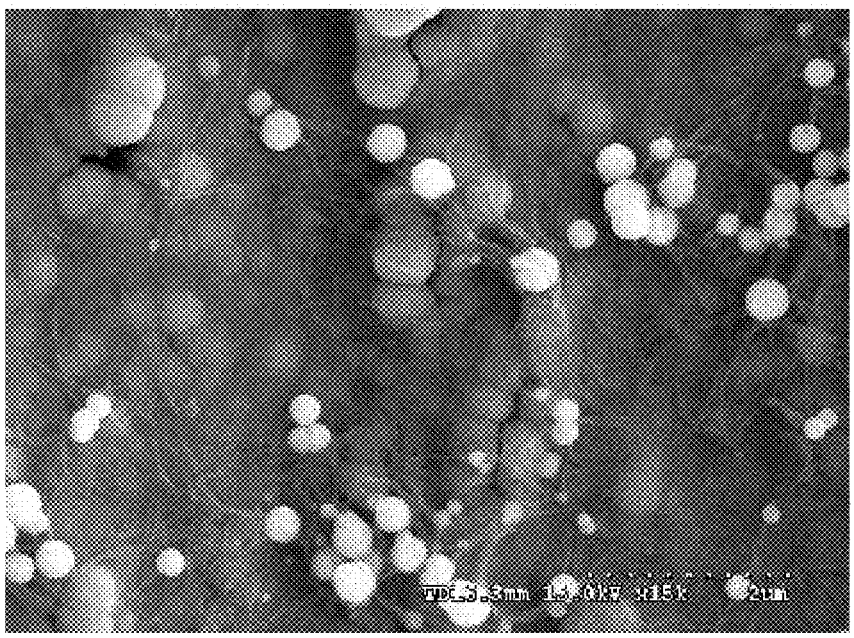
FIG. 6 is a scanning electron microscopic ("SEM") image of the surface of an exemplary embodiment of a field electron emitter manufactured according to Example 1.
Figure 7:
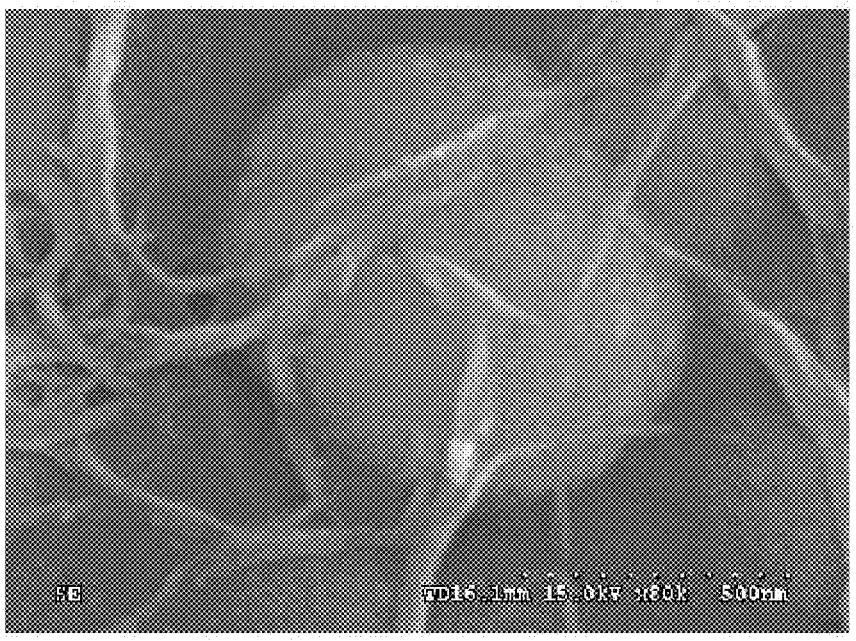
FIG. 7 is a SEM image of the surface of an exemplary embodiment of a field electron emitter manufactured according to Example 2.

FIGS. 6 and 7 are scanning electron microscopic ("SEM") images of surfaces of the field electron emitters manufactured according to Example 1 and 2, respectively. Referring to FIGS. 6 and 7, carbon nanotubes formed with a metal electrode protrude from a surface of the metal electrode.

As described above, according to the one or more of the above embodiments, a field electron emitter includes a metal electrode and a field emission tip, which are formed as a single unitary body. Due to such an integral structure, the field electron emitter may be readily and relatively inexpensively manufactured.

It should be understood that the exemplary embodiments described therein should be considered in a descriptive sense only and not for purposes of limitation. Descriptions of features or aspects within each embodiment should be considered as available for other similar features or aspects in other embodiments.

What is claimed is:

1. A field electron emitter comprising:
a metal electrode;
a plurality of carbon nanotubes, wherein a portion of the plurality of carbon nanotubes protrude from a surface of the metal electrode and a portion of the plurality of carbon nanotubes are in the metal electrode; and
a nucleic acid bonded directly to an unmodified carbon nanotube of the plurality carbon nanotubes.

2. The field electron emitter of claim 1, wherein the nucleic acid contacts at least a portion of the plurality of carbon nanotubes in the metal electrode.

3. The field electron emitter of claim 1, wherein the metal electrode comprises a plating layer.

4. The field electron emitter of claim 1, wherein the metal electrode comprises at least one metal selected from the group consisting of Sc, Ti, V, Cr, Mn, Fe, Co, Ni, Cu, Zn, Pd, Ag, Au, Hg, Pt, Ta, Mo, Zr, Ta, Mg, Sn, Ge, Y, Nb, Tc, Ru, Rh, Lu, Hf, W, Re, Os, Ir, Lr, Rf, Db, Sg, Bh, Hs, Mt, Ds, Rg and Uub.

5. The field electron emitter of claim 1, wherein the metal electrode further comprises at least one element selected from the group consisting of P, B, N, C, O and H.

6. The field electron emitter of claim 1, wherein the nucleic acid comprises at least one nucleic acid selected from the group consisting of DNA, complementary DNA, chloroplast DNA, mitochondrial DNA, messenger DNA, RNA, messenger RNA, transfer RNA, glycerol nucleic acid, locked nucleic acid, peptide nucleic acid and threose nucleic acid.

7. The field electron emitter of claim 1, wherein the nucleic acid comprises at least one base selected from the group consisting of adenine, guanine, thymine, cytosine and uracil.

8. The field electron emitter of claim 1, wherein the plurality of carbon nanotubes comprises at least one carbon nanotube selected from the group consisting of a single-walled carbon nanotube, a double-walled carbon nanotube, a multi-walled carbon nanotube, a metallic carbon nanotube and a semiconducting carbon nanotube.

9. The field electron emitter of claim 1, wherein an amount of the plurality of carbon nanotubes is about 0.1 percent to 80 percent by weight, based on the total weight of the field electron emitter.

10. The field electron emitter of claim 1, further comprising a lower electrode disposed on a bottom surface of the metal electrode.

11. The field electron emitter of claim 1, wherein the nucleic acid is on each of the carbon nanotubes of the plurality of carbon nanotubes.

12. The field electron emitter of claim 1, wherein the nucleic acid is on an entirety of the plurality of the carbon nanotubes.

13. A field electron emission device comprising a field electron emitter, the field electron emitter comprising:
a metal electrode;
a plurality of carbon nanotubes, wherein a portion of the plurality of carbon nanotubes protrude from a surface of the metal electrode and a portion of the plurality of carbon nanotubes are in the metal electrode; and
a nucleic acid bonded directly to an unmodified carbon nanotube of the plurality of carbon nanotubes.

14. A method of manufacturing a field electron emitter, the method comprising:
immersing a substrate in a plating solution;
forming a plating layer on at least a portion of the immersed substrate comprising a nucleic acid bonded directly to an unmodified carbon nanotube; and
removing at least a portion of the nucleic acid exposed on a surface of the plating layer,
wherein the plating solution comprises a plurality of unmodified carbon nanotubes, the nucleic acid and a plurality of metal ions.

15. The method of claim 14, wherein the plating layer is formed by electroplating or electroless plating.

16. The method of claim 14, wherein the plating solution additionally comprises a reductant.

17. The method of claim 14, wherein at least a portion of the plurality of carbon nanotubes contained in the plating solution contact the nucleic acid over a portion of or over an entirety of the contacted nanotubes.

18. The method of claim 14, wherein the plurality of metal ions comprises at least one metal selected from the group consisting of Sc, Ti, V, Cr, Mn, Fe, Co, Ni, Cu, Zn, Pd, Ag, Au, Hg, Pt, Ta, Mo, Zr, Ta, Mg, Sn, Ge, Y, Nb, Tc, Ru, Rh, Lu, Hf, W, Re, Os, Ir, Lr, Rf, Db, Sg, Bh, Hs, Mt, Ds, Rg and Uub.

19. The method of claim 14, wherein the nucleic acid comprises at least one nucleic acid selected from the group consisting of DNA, complementary DNA, chloroplast DNA, mitochondrial DNA, messenger DNA, RNA, messenger RNA, transfer RNA, glycerol nucleic acid, locked nucleic acid, peptide nucleic acid and threose nucleic acid.

20. The method of claim 14, wherein the plurality of carbon nanotubes comprises at least one carbon nanotube selected from the group consisting of a single-walled carbon nanotube, a double-walled carbon nanotube, a multi-walled carbon nanotube, a metallic carbon nanotube and a semiconducting carbon nanotube.

21. The method of claim 14, wherein the nucleic acid is removed using at least one method selected from the group consisting of sintering, etching, chemical reacting and detaching.

22. A field electron emitter comprising:
a metal electrode; and
a plurality of complexes on the metal electrode, each complex comprising an unmodified carbon nanotube, a nucleic acid, and a metal ion, wherein the nucleic acid contacts the carbon nanotube, and wherein a portion the carbon nanotubes protrude from a surface of the metal electrode and a portion of the carbon nanotubes are in the metal electrode.

23. The field electron emitter of claim 22, wherein the metal ion comprises a Group 1 to 9 element.

* * * * *